US006734379B1

(12) United States Patent
Savadian et al.

(10) Patent No.: US 6,734,379 B1
(45) Date of Patent: May 11, 2004

(54) ELECTRONIC POWER TOOL LOCK-OUT MECHANISM

(75) Inventors: Norair Savadian, City of Industry, CA (US); Thomas J. Wheeler, Pomona, CA (US)

(73) Assignee: Olympia Group, Inc., City of Industry, CA (US)

( * ) Notice: Subject to any disclaimer, the term of this patent is extended or adjusted under 35 U.S.C. 154(b) by 0 days.

(21) Appl. No.: 10/236,252

(22) Filed: Sep. 6, 2002

(51) Int. Cl.[7] ..... H01H 9/28
(52) U.S. Cl. ..... 200/41.01; 200/43.17
(58) Field of Search ..... 200/43.01, 43.11, 200/43.12, 318, 330, 331, 43.13, 43.16, 43.17, 43.18, 42.02, 283, 339, 332.2; 70/61, 278.1

(56) References Cited

U.S. PATENT DOCUMENTS 4,451,865 A * 5/1984 Warner et al. ..... 361/23
4,700,031 A * 10/1987 Claghorn et al. ..... 200/522
5,070,219 A * 12/1991 Grosskrueger et al. .. 200/43.08
5,184,491 A * 2/1993 Schittenhelm ..... 70/278.1
5,592,032 A * 1/1997 Keizer et al. ..... 307/116
5,638,945 A * 6/1997 Fukinuki et al. ..... 200/43.17
5,725,086 A 3/1998 Cooper ..... 200/302.3
5,845,523 A * 12/1998 Butterweck et al. ..... 70/278.1
5,881,584 A * 3/1999 Brunoski et al. ..... 70/68
5,894,277 A * 4/1999 Keskin et al. ..... 340/5.21
6,072,393 A 6/2000 Todd ..... 340/568.2
6,116,066 A * 9/2000 Gartner et al. ..... 70/278.1
6,181,032 B1 * 1/2001 Marshall et al. ..... 307/150
6,298,699 B1 * 10/2001 Gartner et al. ..... 70/278.1

* cited by examiner

*Primary Examiner*—Michael Friedhofer
*Assistant Examiner*—Lisa Klaus
(74) *Attorney, Agent, or Firm*—Stallman & Pollock LLP

(57) ABSTRACT

A power tool assembly is provided that includes a tool, and on/off switch, and a tool lock-out device connected to the on/off switch. The on/off switch is operative to selectively connect/disconnect the on/off switch to/from the tool, respectively.

11 Claims, 6 Drawing Sheets

ELECTRONIC POWER TOOL LOCK-OUT MECHANISM

TECHNICAL FIELD

The present invention relates to power tools and, in particular, to a lock-out device for a power tool that requires that a code be entered before the tool can operate.

BACKGROUND OF THE INVENTION

While the inventor is aware that lock-out keypads have been utilized on vehicles to, for example, impede the operation of the vehicle by someone under the influence of alcohol or drugs, he is not aware of the use of a lock-out device in conjunction with a power tool.

SUMMARY OF THE INVENTION

A preferred embodiment of the present invention provides a lock-out device that includes a lock-out on/off switch that is connected to the tool's power supply and controls the operation of the tool and a code entry device that closes the lock-out on/off switch upon entry of a user-programmable code that enables the tool for operation. That is, the tool is not enabled for operation unless the lock-out device is activated to connect the on/off switch to the tool.

The features and advantages of the present invention will be more fully appreciated upon consideration of the following detailed description of the invention and the accompanying drawings that set forth an illustrative embodiment in which the principles of the invention are utilized.

DETAILED DESCRIPTION OF THE INVENTION

The present invention provides a lock-out device for a power tool that requires that a code be entered before the tool can operate.

Figure 1:
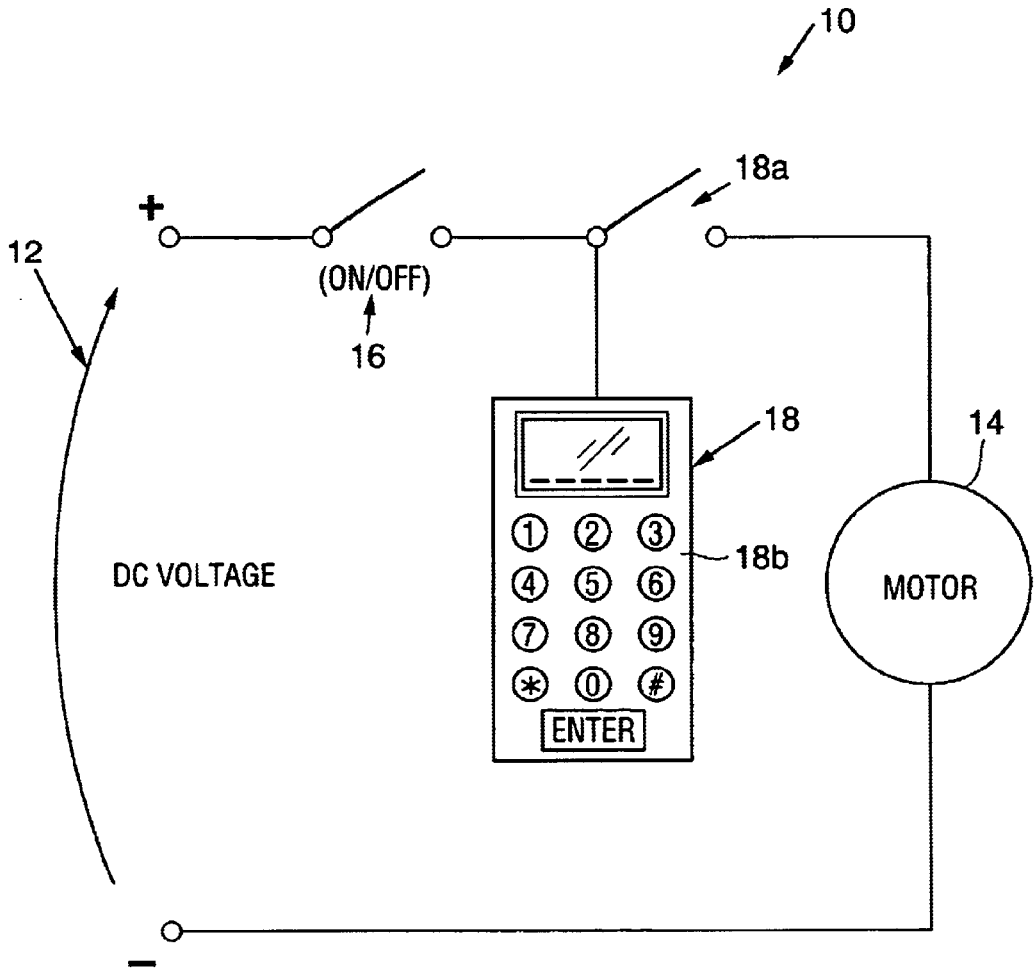
FIG. 1 is a block diagram illustrating a DC current tool lock-out device in accordance with the present invention.

FIG. 1 shows a DC current embodiment of a lock-out device 10 in accordance with the present invention. The DC lock-out mechanism 10 utilizes a source of DC current 12 that drives a power tool motor 14 through the tool's normal on/off switch 16. In the FIG. 1 embodiment, a DC lock-out device 18 is connected in series between the normal on/off switch 16 and the tool motor 14. The DC lock-out device 18 is operative to selectively connect/disconnect the tool's on/off switch 16 to/from the tool motor 14, respectively. The DC lock-out device 18 includes a lock-out switch 18*a* and a code entry device 18*b*, e.g. a keypad, that closes the lock-out switch 18*a* upon entry of a user-programmable code.

Figure 2:
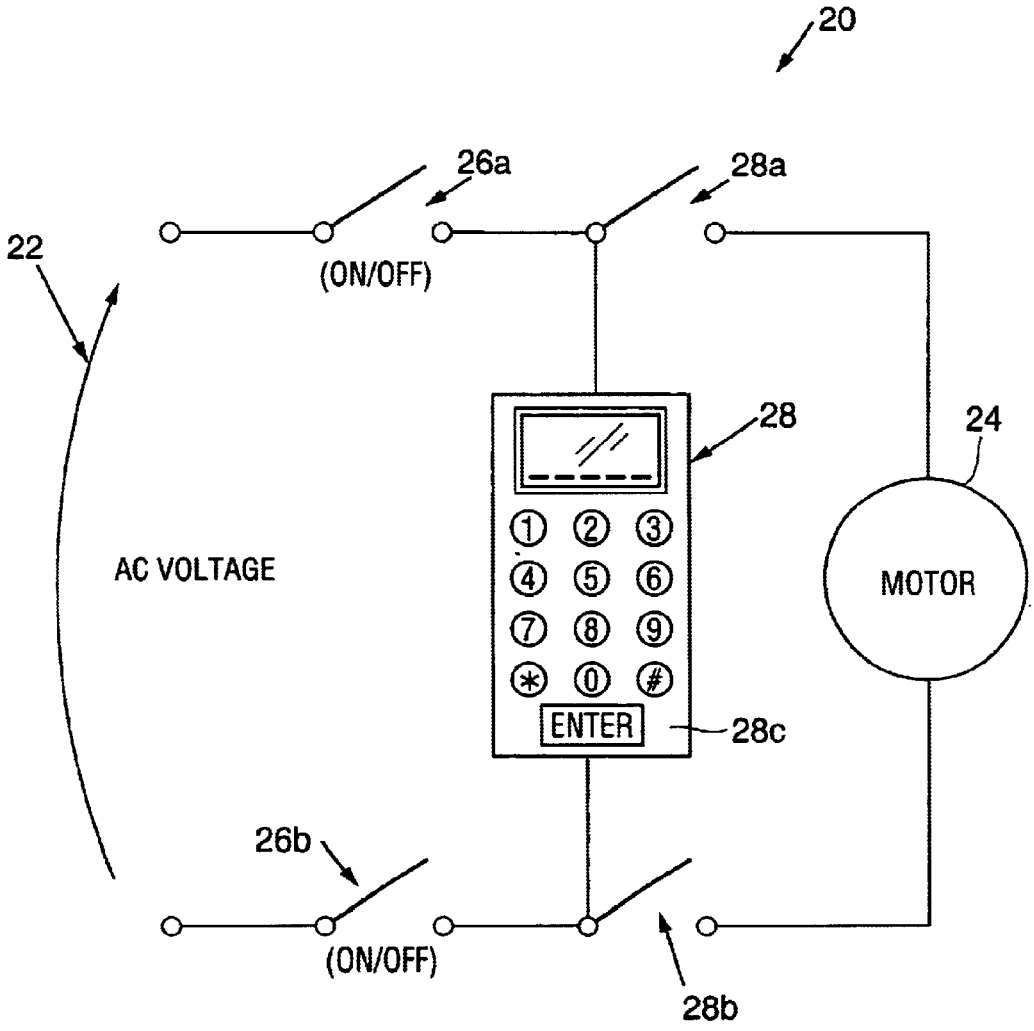
FIG. 2 is a block diagram illustrating an AC current lock-out device in accordance with the present invention.

FIG. 2 shows an AC current lock-out mechanism 20 in accordance with the present invention. The AC lockout mechanism 20 utilizes a source of AC current 22 that drives a power tool motor 24 through the tool's normal on/off switches 26*a* and 26*b*. In the FIG. 2 embodiment, an AC lock-out device 28 is connected in series between the on/off switches 26*a* and 26*b* and the tool motor 24. The AC lock-out device is operative to selectively connect/disconnect the on/off switches 26*a* and 26*b* to/from the tool motor 24. The AC lock-out device 28 includes lock-out switches 28*a* and 28*b* and a code entry device 18*c*, e.g. a keypad, that closes the two lockout switches 28*a* and 28*b* upon entry of a user-programmable code.

The embodiments of the invention shown in FIGS. 1 and 2 are not intended to be limiting. The present invention is intended to cover any means of electronically or electromechanically preventing a power tool from operating without a code being entered first.

Those skilled in the art will appreciate that there are many permutations of how this assembly can operate. One option is to require the code to be entered every time the unit is turned on. A second option would require the code to be re-entered after a set duration of time. For example, if the code is entered, then the tool could be operated in the normal manner for the next 30 minutes. A third option would require the code to be entered to open as well as to close the extra switch. For example, once the code is entered, anyone could operate the tool until the code is entered again.

The preferred embodiment would depend on a plurality of factors including but not limited to whether the tool is AC or DC, whether the tool is hand held or bench mounted, and how much the different implementations cost to manufacture.

Location of the lock-out device would depend on the power tool with which the device is utilized. In general, the device would be located in a spot that would allow easy physical and visual access to the keypad and also not compromise the ergonomic function of the tool. The device would not necessarily have to be on/in the tool proper, but could be on the power cord as well. Furthermore, utilization of the lock-out mechanism is not limited to tools having a power supply cord, but is applicable to battery-operated tools as well.

Figure 3:
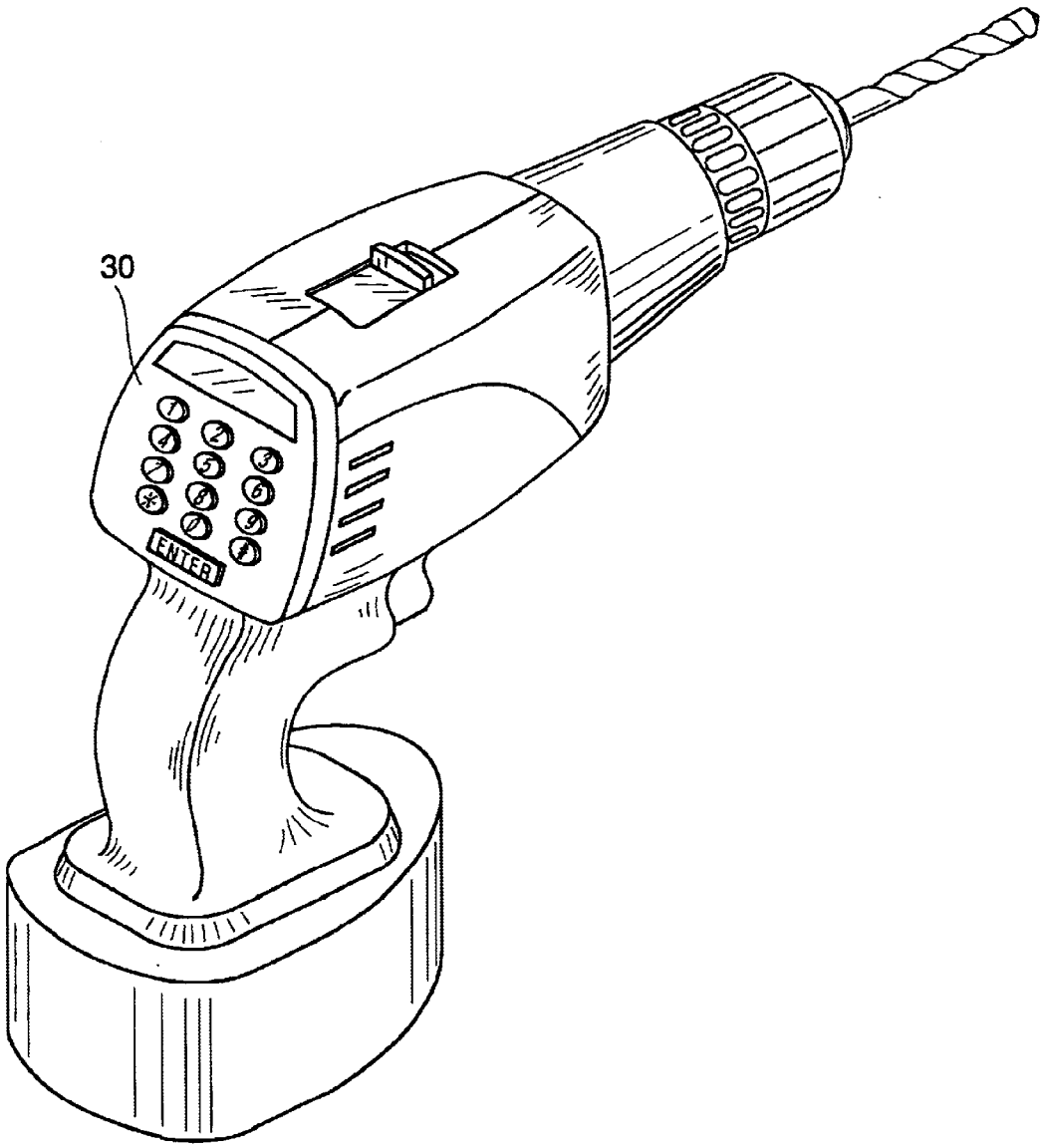
FIG. 3 is a perspective drawing illustrating an electronic lock-out device in accordance with the present invention utilized with a cordless drill.
Figure 4:
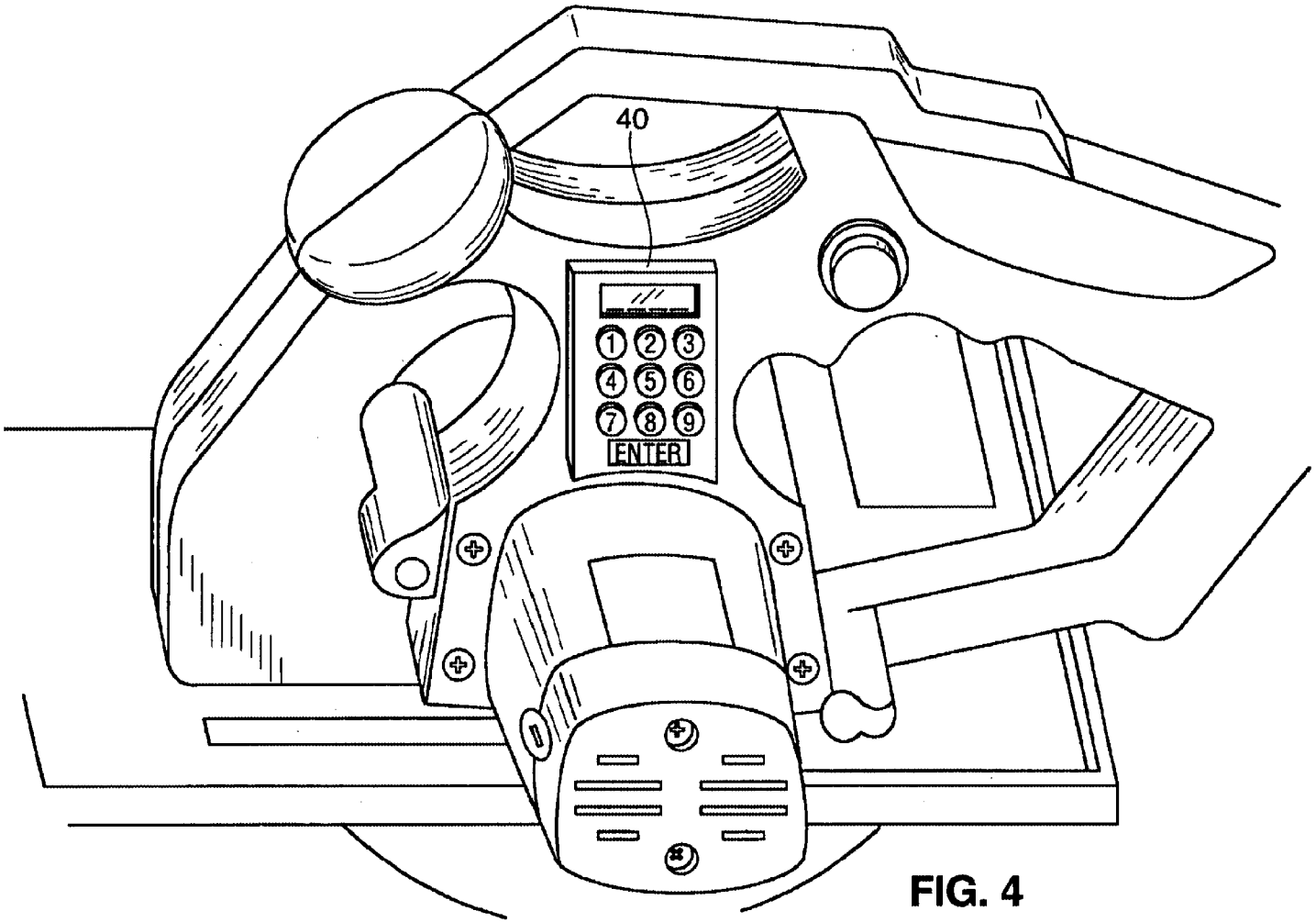
FIG. 4 is a perspective drawing illustrating an electronic lock-out device in accordance with the present invention utilized with a circular saw.

For example, FIG. 3 shows a lock-out device 30 utilized with a cordless drill. FIG. 4 shows a lock-out device 40 utilized with a circular saw. In both the FIG. 3 embodiment and the FIG. 4 embodiment, the lock-out device is mounted in a location that has little or no adverse effect on the ergonomics of the tool.

Figure 5:
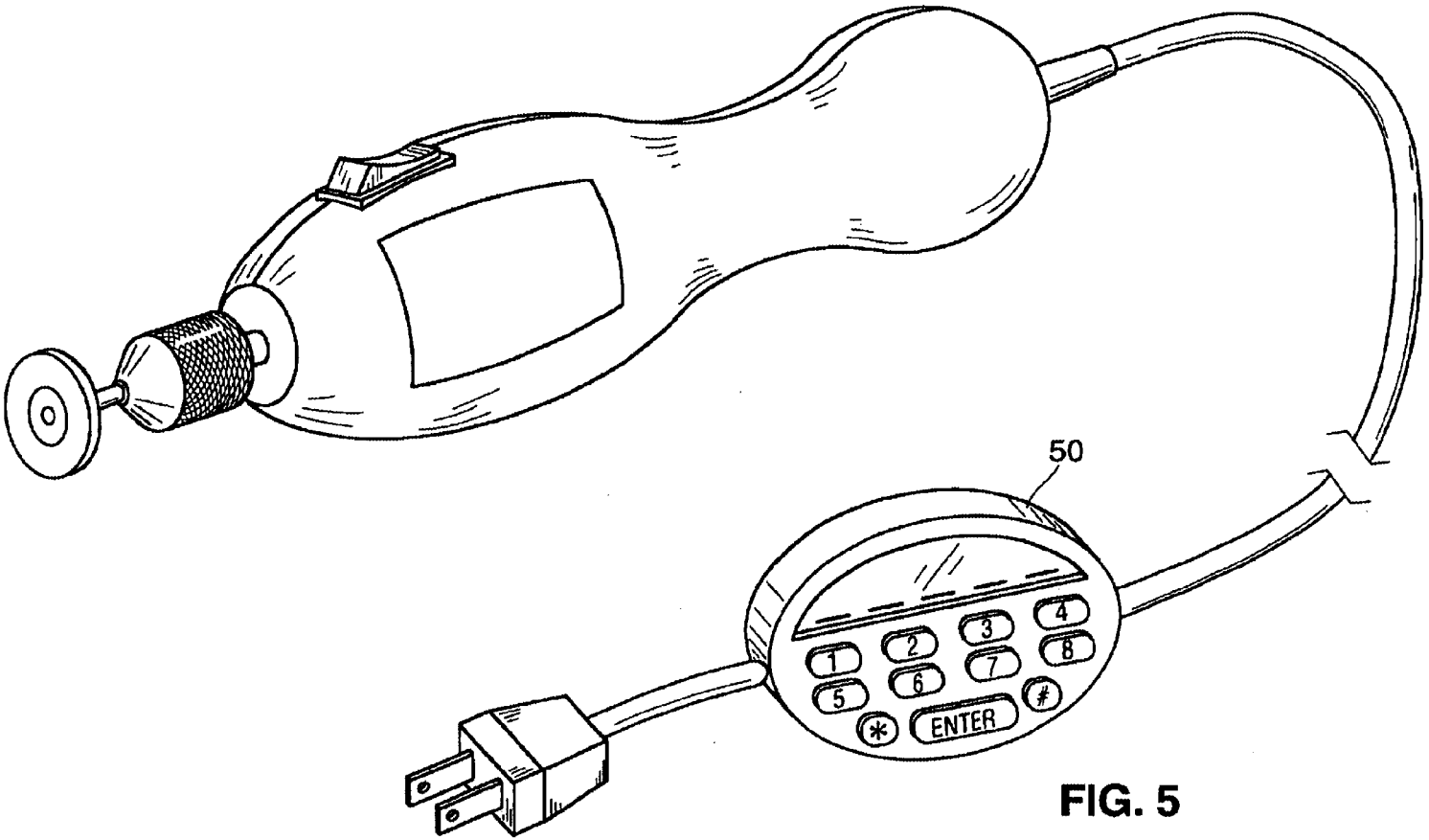
FIG. 5 is a perspective drawing illustrating an electronic lock-out device in accordance with the present invention utilized with a rotary tool.

FIG. 5 shows a lock-out mechanism 50 incorporated into the power cord of a so-called rotary tool. For such small tools, it may be advantageous to mount the device on the cord so that ergonomics and function are not adversely affected.

Figure 6:
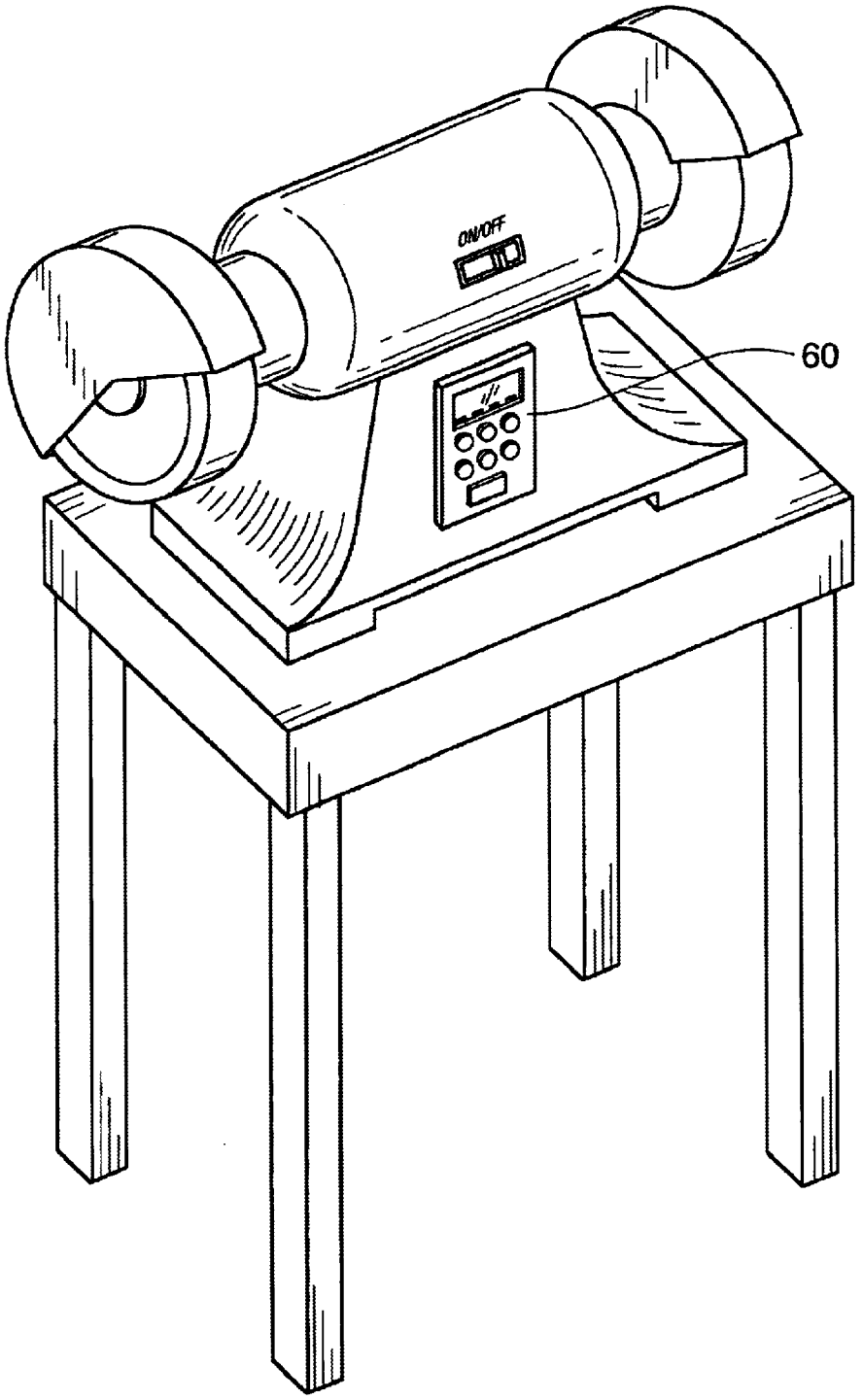
FIG. 6 is a perspective drawing illustrating an electronic lock-out device in accordance with the present invention utilized on a bench-mounted tool.

FIG. 6 shows a lock-out mechanism 60 utilized with a grinder, i.e. a bench mounted tool, to illustrate that utilization of the present invention is not limited to hand-operated power tools.

The code entry device or keypad could have as many numbers, letters and symbols as choices for the code as desired. As the number of choices and the length of the code increases, the possible permutations for the code increases and the device becomes more difficult to override.

The lock-out device provides a number of advantages. First, it prevents those not qualified or desired to use the tool, such as a small child, from using the tool. Second, the device deters theft; if one realized that the tool cannot be used without knowing a code, then it would be less likely that the tool would be stolen. Third, the device gives the user a more personalized experience with the tool.

It should be recognized that a number of variations of the above-identified embodiments of the invention would be obvious to one of skill in the art in view of the foregoing description. Accordingly, although specific embodiments and methods of the present invention are shown and described herein, the invention is not to be limited by the specific embodiments. Rather, the scope of the invention is to be defined by the following claims and their equivalents.

What is claimed:

1. A lock-out device for a power tool that includes a motor connectable to an electrical power supply, the lock-out device comprising:

a lock-out on/off switch disposed between the motor and the power supply; and a code entry device connected to the lock-out on/off switch such that the lock-out on/off switch connects the motor to the power supply only upon entry of a code into the code entry device.

2. A lock-out device as in claim 1, and wherein the code entry device is a keypad.

3. A lock-out device as in claim 1, and wherein the power tool is a hand-operated tool.

4. A lock-out device as in claim 1, and wherein the power tool is a bench-mounted tool.

5. A lock-out device as in claim 1, and wherein the power supply comprises a battery.

6. A lock-out device as in claim 1, and wherein the motor is connectable to the power supply by a power cord electrically connected to the motor, and wherein the lock-out device is mounted on the power card.

7. A lock-out device as in claim 1, and wherein the lock-out device is mounted on the power tool.

8. A lock-out device as in claim 1, and wherein the code is user-programmable.

9. A lock-out device as in claim 1, and wherein the power supply is a DC supply.

10. A lock-out device as in claim 1, and wherein the power supply is an AC supply.

11. A power tool assembly comprising:

a power tool that includes a motor connectable to a power supply;

a tool on-off switch disposed between the motor and the power supply for connecting the motor to the power supply; and a lock-out device that includes (i) a lock-out on-off switch disposed between the motor and the power supply; and (ii) a code entry device connected to the lock-out on-off switch such that the lock-out on-off switch connects the motor to the power supply only upon entry of a code into the code entry device.

* * * * *